US006454443B2

(12) United States Patent
Natsume et al.

(10) Patent No.: US 6,454,443 B2
(45) Date of Patent: Sep. 24, 2002

(54) METHOD OF DETERMINING REFLECTIVE SURFACE OF REFLECTOR IN VEHICLE LAMP

(75) Inventors: Kazunori Natsume; Masahiro Maeda, both of Shimizu (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/754,300

(22) Filed: Jan. 5, 2001

(30) Foreign Application Priority Data

Jan. 7, 2000 (JP) ..... 2000-001677

(51) Int. Cl.[7] ..... F21V 7/04
(52) U.S. Cl. ..... 362/297; 362/346; 362/518
(58) Field of Search ..... 362/296, 297, 362/341, 346, 347, 348, 516–518

(56) References Cited

U.S. PATENT DOCUMENTS

| | | | | |
|---|---|---|---|---|
| 3,710,095 A | * | 1/1973 | Donohue et al. | 362/348 |
| 4,087,682 A | * | 5/1978 | Kolodziej | 362/297 |
| 4,481,563 A | | 11/1984 | Snyder et al. | 362/296 |
| 4,495,552 A | | 1/1985 | Graff | 362/297 |
| 4,959,757 A | | 9/1990 | Nakata | 362/518 |
| 5,065,287 A | | 11/1991 | Staiger et al. | 362/518 |
| 5,406,464 A | * | 4/1995 | Saito | 362/518 |
| 5,655,828 A | | 8/1997 | Yamamoto et al. | 362/516 |
| 5,707,141 A | | 1/1998 | Yamamoto et al. | 362/520 |
| 5,836,668 A | | 11/1998 | Ishikawa et al. | 362/459 |
| 5,876,114 A | * | 3/1999 | Nino | 362/518 |

FOREIGN PATENT DOCUMENTS

JP 9-33708 2/1997

OTHER PUBLICATIONS

Patent Abstract of Japan 09–033708 Feb. 7, 1997.

* cited by examiner

*Primary Examiner*—Alan Cariaso
(74) *Attorney, Agent, or Firm*—Sughrue Mion, PLLC

(57) ABSTRACT

In a method of determining the shape of reflective surface 10*a* of reflector 1 in the structure in which the basic shape is a free-formed surface 20 satisfying shape constraints or the like and in which reflective surface elements are assigned to an array of segments obtained by dividing the free-formed surface 20, evaluation and selection of the surface shape is carried out at two stages; i.e., evaluation and selection according to light incidence angles at the stage of creation of the free-formed surface 20 and evaluation and selection according to light reflecting regions at the stage of creation of a reflective surface consisting of a plurality of reflective surface elements. This reduces nonuniformity of in-surface light distribution during on periods of a lamp, in the reflective surface obtained, and thus improves design efficiency thereof.

7 Claims, 10 Drawing Sheets

METHOD OF DETERMINING REFLECTIVE SURFACE OF REFLECTOR IN VEHICLE LAMP

BACKGROUND OF THE INVENTION

1. Field of the Invention

The present invention relates to a method of determining a reflective surface of a reflector in a vehicle lamp used in vehicles such as automobiles and the like.

2. Related Background Art

The vehicle lamps need to meet (1) the conditions from the aspect concerning the function as lamps and, in addition thereto, (2) the conditions from the aspect concerning the shape (shape constraints), and (3) the conditions from the aspect concerning the appearance (appearance constraints) because of their use in a mounted state on the vehicles such as the automobiles and the like. It is thus necessary to realize lamps optimized as to the conditions from the functional aspect while satisfying the given constraints from the shape aspect and the appearance aspect.

The conditions from the functional aspect include light uniformity with which the entire lamp lights uniformly, light diffusibility with which light is properly diffused to be observed from various directions, and so on, depending upon types of lamps.

As for the constraints from the vehicle and body side, the shape constraints include conditions defined by the volume and shape of lamp receiving portions of the body, the continuous shape of the outer surface of the lamp (the outer surface of lens) from the other body portions, and so on. The appearance constraints include conditions resulting from harmony with the appearance of the other body portions, requirements from the design aspect of the body, and so on.

SUMMARY OF THE INVENTION

In recent years, there are increasing needs for lamps meeting strict shape constraints, e.g., further decrease in the depth of the lamp, because of restrictions on the lamp receiving portions from the aspect of construction of the body, the increasing tendency toward fascinating styling of cars, and so on. Under such circumstances, when a lamp was constructed, for example, using a reflector wherein the basic shape of its reflective surface was a unifocal paraboloid, decrease was insufficient in the thickness of the lamp and it was difficult to comply with the above-stated shape constraints such as the decrease in the depth of the lamp.

As against it, another reflector was proposed in such structure that the basic shape of the reflective surface was a free-formed surface created so as to match the shape constraints and other conditions. With use of the free-formed surface, it is relatively easy to meet the shape constraints such as the decrease in the depth of the lamp because of its degrees of freedom in designing thereof (for example, reference is made to Japanese Patent Application Laid-Open No. H09-33708). However, since reflective surface shapes of respective portions in the reflective surface need to satisfy the conditions from the functional aspect of reflecting the light from a light source into the direction along the given optical axis, they are normally formed in the shape of paraboloid of revolution or in the shape approximate thereto with light diffusing capability. Therefore, the reflective surface is formed by dividing the above-stated free-formed surface into a plurality of segments and assigning reflective surface elements having respective, reflective surface shapes of paraboloids of revolution or the like to the respective segments.

When the shape of the entire reflective surface is determined by first determining the free-formed surface as a basic shape, thereafter dividing the free-formed surface into segments, and then assigning reflective surface elements to the segments as described above, there can occur nonuniformity of in-surface reflection distribution of the light from the light source; e.g., on the reflective surface in each reflective surface element there appears a dark area even during on periods of the lamp as it is shadowed by another reflective surface element in a view from the light source. The optical nonuniformity would be unobtrusive during the on periods of the lamp as long as such dark areas appear at relatively low rates and at approximately uniform rates in the respective reflective surface elements.

In the creation of the reflective surface using the free-formed surface as a basic shape, however, the shape thereof normally largely varies among individual lamps, depending upon the given shape constraints and other conditions, and the shape of the free-formed surface often becomes asymmetric. Particularly, the conditions for the decrease in the depth of the lamp impart severe conditions on incidence of the light from the light source and on reflection thereof into the direction of the optical axis at each part of the reflective surface. For that reason, there arise problems that it becomes difficult to obtain the reflective surface with unobtrusive distribution nonuniformity of bright portions receiving and reflecting the light and the other dark portions while satisfying the given shape constraints in each lamp and that the design efficiency is lowered, e.g., because the shape of the reflective surface has to be redesigned many times in the design steps.

The present invention has been accomplished in view of the above problems and an object of the present invention is to provide a method of determining a reflective surface of a reflector in a vehicle lamp, by which the reflective surface consisting of a plurality of reflective surface elements can be determined with reduced in-surface distribution nonuniformity of light during the on periods of the lamp and at increased design efficiency.

In order to accomplish the above object, a reflective surface determining method of a reflector in a vehicle lamp according to the present invention is a method comprising (1) a condition setting step of setting a light source position at which a light source is to be placed, and an optical axis that passes the light source position and that defines a direction into which light from the light source is to be reflected by a reflector; (2) a free-formed surface creating step of creating a free-formed surface satisfying a predetermined shape constraint; (3) a free-formed surface selecting step of selecting the free-formed surface satisfying a predetermined functional condition, as a free-formed surface to be used for creation of a reflective surface; (4) a reflective surface creating step of dividing the free-formed surface selected, into a plurality of segments and assigning a reflective surface element for reflecting the light from the light source placed at the light source position, into the direction along the optical axis, to each of the segments, thereby creating a reflective surface including a plurality of reflective surface elements; and (5) a reflective surface selecting step of setting an evaluation axis for evaluation of optical reflection characteristics of the reflective surface, preparing a light reflecting region distribution by determining for each portion of the reflective surface a reflecting region accepting the light from the light source placed at the light source position and reflecting the light into a direction of the evaluation axis, and selecting the reflective surface with the light reflecting region distribution satisfying a predetermined region distribution condition, as a reflective surface to be used for the reflector.

In the above reflective surface determining method of the reflector in the vehicle lamp, as to the shape of the reflective surface obtained in the determination (or in the designing) of the reflective surface, the evaluation and selection during the designing thereof is carried out at each of the two stages, which are the stage of creation of the free-formed surface being the basic shape and the stage of creation of the reflective surface with the plurality of reflective surface elements assigned. This provides the reflective surface determining method capable of efficiently obtaining the reflector of the vehicle lamp that satisfies the shape constraints including the decrease in the depth and that realizes the preferred optical uniformity during the on periods in terms of the function of the lamp.

In this method, the evaluation and selection at the stage of the free-formed surface is carried out according to the condition from the functional aspect as a reflective surface of the reflector used in the lamp (functional condition). At the stage of the creation of the free-formed surface, some consideration can be given to the condition of optical uniformity and other conditions as a reflective surface. The shape of this free-formed surface also affects the way of making a shadow after the creation of the reflective surface elements. The evaluation on these problems is conducted at the stage of the free-formed surface and then the selection of the free-formed surface is performed.

The evaluation and selection at the stage of the reflective surface consisting of the plurality of reflective surface elements is carried out according to the reflecting regions that reflect the light into the direction of the set evaluation axis. A light reflecting region on the reflective surface indicates how the region is seen (or how the region is lighting) when the lamp is seen from the direction of the evaluation axis during the on periods of the lamp. In this respect, there arise the problems including the problem that the dark area appears even during the on periods of the lamp while being shadowed by another reflective surface element in a view from the light source, on the reflective surface in each reflective surface element, as described above. At the stage of the reflective surface, the evaluation on these problems is conducted with preparation of the light reflecting region distribution and then the selection of the reflective surface is carried out.

The occurrence of nonuniformity can be reduced in the in-surface light distribution during the on periods of the lamp on the finally obtained reflective surface by carrying out the evaluation and selection by the different methods at the two stages as described above, different from the method in which the evaluation of the reflective surface shape is carried out, for example, only at the stage of the reflective surface consisting of the plurality of reflective surface elements. The design efficiency can be improved by simplifying the design steps for obtaining the reflective surface with preferred optical uniformity.

The evaluation of the reflective surface in the reflective surface selecting step can be performed, for example, by checking how each portion in the reflective surface lights up during the on periods of the lamp by a method of ray tracing or the like based on computation.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
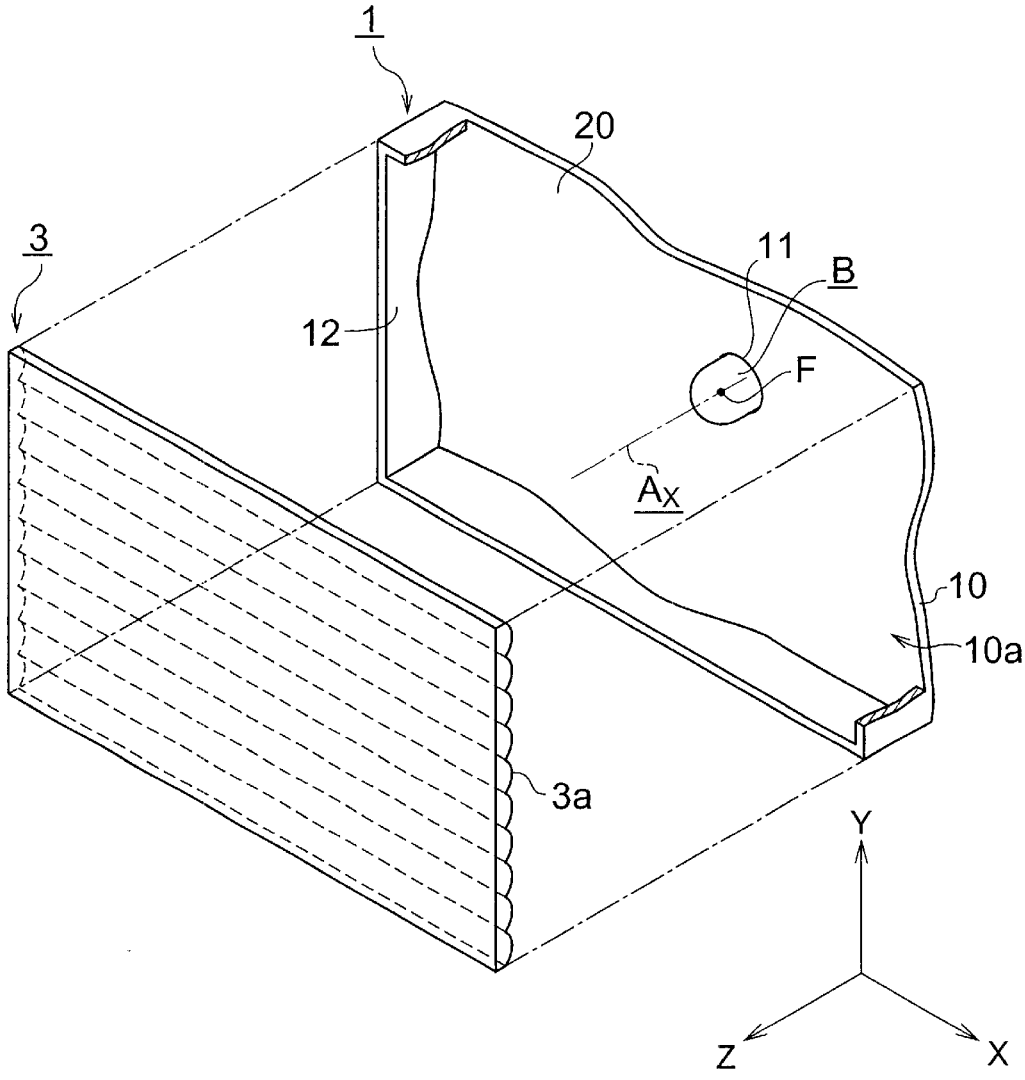
FIG. 1 is an exploded perspective view, partly broken, to show the structure of an embodiment of a vehicle lamp.

The preferred embodiments of the reflective surface determining method of the reflector in the vehicle lamp according to the present invention will be described below in detail with reference to the drawings. The same elements will be denoted by the same reference symbols in the description of the drawings and redundant description will be omitted. It is also noted that dimensional ratios in the drawings do not always exactly match those in the description.

Figure 2:
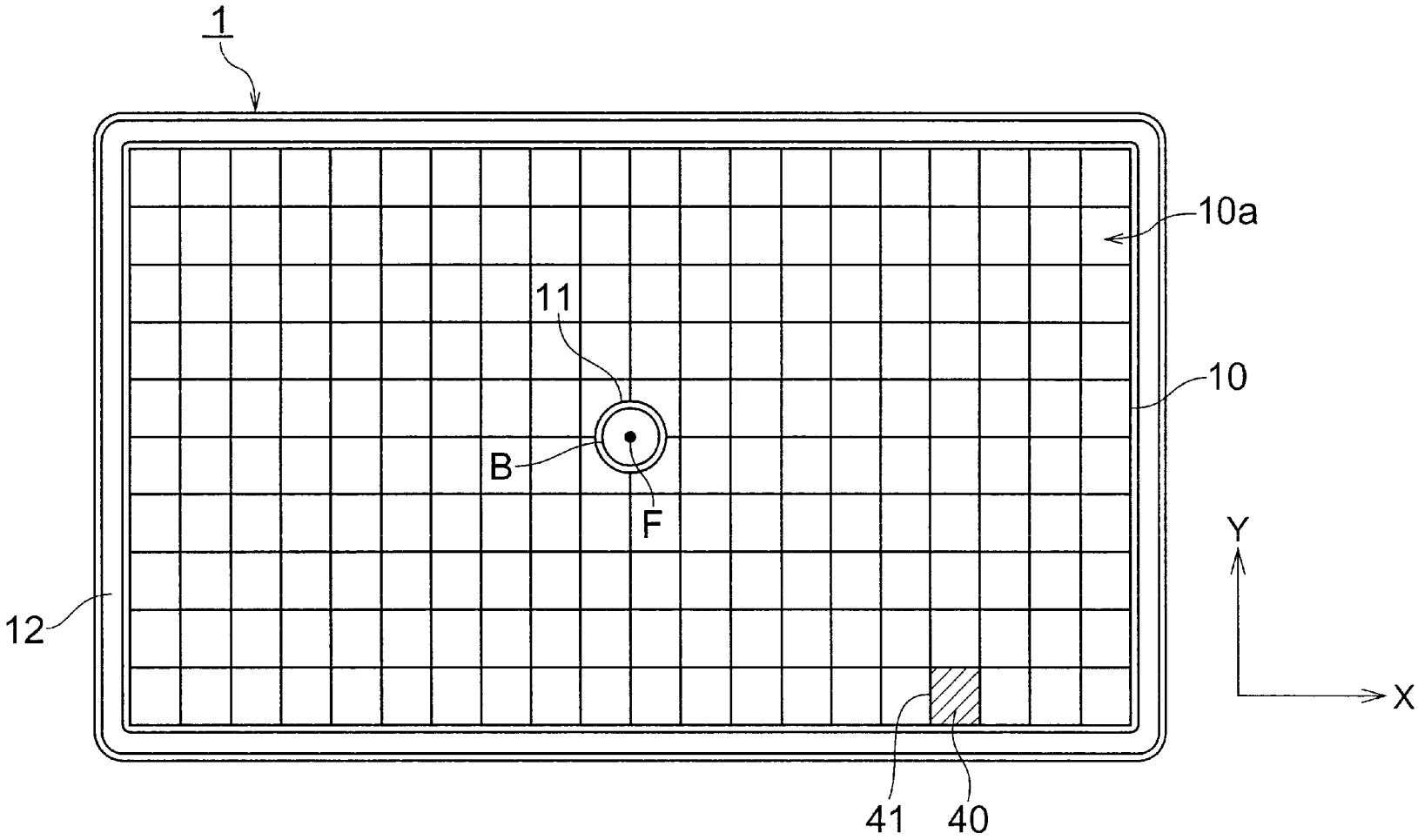
FIG. 2 is a plan view to show the structure of the reflector in the vehicle lamp illustrated in FIG. 1.

FIG. 1 is an exploded perspective view, partly broken, of the structure of an embodiment of the vehicle lamp provided with the reflector, which has the reflective surface determined by the reflective surface determining method of the reflector in the vehicle lamp according to the present invention. FIG. 2 is a plan view to show the structure of the reflector in the vehicle lamp illustrated in FIG. 1. In FIG. 1, the structures of fixing and positioning portions of the reflector and lens are omitted from the illustration. In the description below, the X-, Y-, and Z-coordinate axes are defined as illustrated in FIG. 1 and FIG. 2; the X-axis is taken along the lateral direction of the lamp, the Y-axis along the vertical direction, and the Z-axis along the depthwise direction, which is the direction of the optical axis Ax of the lamp.

The vehicle lamp of the present embodiment can be applied, for example, to marker lamps such as tail lamps of automobiles and the like, and this lamp is constructed with the reflector 1 and the lens 3, as illustrated in FIG. 1.

The reflector 1 is formed so as to spread in directions approximately normal to the optical axis Ax, which is preset from the longitudinal direction of the vehicle to which the lamp is to be mounted, the light projecting direction of the lamp, and so on. The reflector 1 is formed in an almost rectangular shape in a view from the direction of the Z-axis and has a reflector part 10 whose reflective surface 10*a* for reflecting light is a surface opposed to the lens 3 placed in front thereof along the optical axis Ax, and a rim part 12 for positioning, fixing, etc. to the lens 3, which is structured so as to enclose the reflective surface 10*a*. A light-source bulb B is inserted into a light-source inlet 11 bored at the almost center position in the reflector part 10 and is fixed relative to the reflector 1 so that the illuminant point F thereof is located at a predetermined position (light source position) on the optical axis Ax. The lens 3 is set nearly perpendicular to the optical axis Ax.

It is noted herein that the present embodiment provides an example as to the various conditions, including the peripheral shape of the approximately rectangular shape of the reflector 1 (the outline shape of the rim part 12), the setting angle of the lens 3 relative to the optical axis Ax, the location of the light-source bulb B, and so on. In general, those conditions are appropriately set in consideration of the shape constraints imposed from the body side, including the volume and shape of the lamp receiving part of the body, the continuous shape of the outer surface of the lamp (the outer surface of the lens) from the other body portions. There are no particular restrictions on specific production methods of the reflective surface 10*a* of the reflector 1, and the reflective surface determining method described below can be applied to lamps provided with reflectors formed by various production methods.

In FIG. 1, the reflector 1 and lens 3 forming the vehicle lamp are illustrated in a disassembled state and the shape of the reflective surface 10*a* is shown by partly breaking the upper and right portions (in the figure) of the rim part 12 of the reflector 1. In this FIG. 1, however, an array of reflective surface elements 40 (see FIG. 2) forming the reflective surface 10*a* are not illustrated and the surface shape thereof is schematically shown by the free-formed surface 20, which is the basic shape of the reflective surface 10*a*.

The free-formed surface 20 is a curved surface used for determination of the shape of the reflective surface, as a surface to specify the basic shape of the reflective surface 10*a*. The basic shape is not a single paraboloid of revolution, but is the free-formed surface selected as a curved surface satisfying certain conditions, e.g., satisfying the shape constraints.

The reflective surface 10*a* is formed by assigning a plurality of reflective surface elements 40 (individual sections of the rectangular shape in FIG. 2) to respective segments 41 obtained by dividing the free-formed surface 20 of the basic shape into an array pattern as illustrated in FIG. 2. In FIG. 2, the reflective surface element 40 assigned to one of the segments 41 is hatched in order to clarify the range thereof.

In the present embodiment the reflective surface 10*a* is constructed in the divided structure into the segments at fixed intervals in the X-axis direction and in the Y-axis direction normal to each other so that the shapes of the segments 41 corresponding to the respective, reflective surface elements 40 are same and rectangular in a view from the Z-axis direction. Each reflective surface element 40 is formed in such a reflective surface shape as to reflect the light from the light-source bulb B into the direction along the optical axis Ax.

Figure 3:
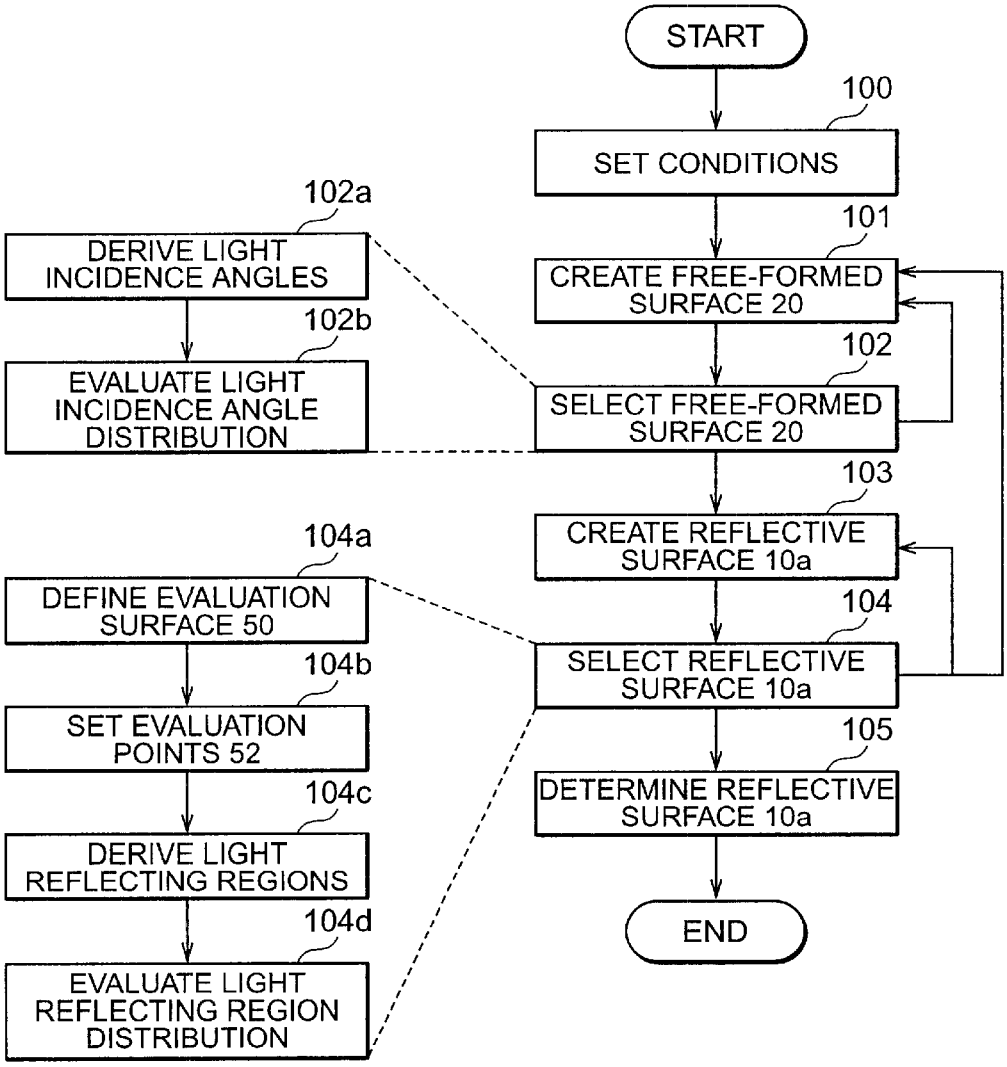
FIG. 3 is a flowchart to show an embodiment of the reflective surface determining method of the reflector in the vehicle lamp.

The reflective surface determining method of the reflector in the vehicle lamp will be described below using the example of the vehicle lamp in the above structure. FIG. 3 is a flowchart to show an embodiment of the reflective surface determining method of the reflector in the vehicle lamp according to the present invention. The reflective surface determining method according to the present embodiment has steps of a condition setting step 100, a free-formed surface creating step 101, a free-formed surface selecting step 102, a reflective surface creating step 103, and a reflective surface selecting step 104 and the shape of the reflective surface is finally determined in a reflective surface determining step 105. Further, the free-formed surface selecting step 102 includes a light incidence angle deriving step 102*a* and a light incidence angle distribution evaluating step 102*b*. The reflective surface selecting step 104 includes an evaluation surface defining step 104*a*, an evaluation point setting step 104*b*, a light reflecting region deriving step 104*c*, and a light reflecting region distribution evaluating step 104*d*.

Condition Setting Step (step 100)

Various conditions necessary for the determination of shape are first set in the determination of the shape of the reflective surface of the reflector used in the vehicle lamp.

The set conditions are, for example, the position where the light-source bulb B is located and the position of the illuminant point F thereof (the light source position), the optical axis Ax which is an axis passing the light source position and which specifies the direction along which the light from the light source is reflected by the reflective surface and emitted from the lamp, and so on. Other conditions may also be set if necessary. Besides the set conditions, the shape constraints from the body side and other conditions are preliminarily given for the lamp or for the reflector.

Free-formed Surface Creating Step (step 101)

The next step is a step of creating the free-formed surface 20 as a basic shape of the reflective surface 10*a*.

The free-formed surface 20 is created in the shape satisfying the conditions from the functional aspect of the lamp, the shape constraints from the body side, and so on. One of the conditions from the functional aspect for the free-formed surface 20 is optical uniformity concerning the optical reflection characteristics of the reflective surface 10*a*, and required functions differ depending upon types of lamps. The free-formed surface 20 is created with reference to these conditions and the conditions of the light source position (the light-source bulb B and the illuminant point F) and the optical axis Ax etc. set in the condition setting step 100.

Free-formed Surface Selecting Step (step 102)

The next step is a step of selecting a free-formed surface to be used for the creation of the reflective surface 10*a* from free-formed surfaces 20 created in the free-formed surface creating step 101.

In the present embodiment, the free-formed surface selecting step 102 consists of the light incidence angle deriving step 102*a* and the light incidence angle distribution evaluating step 102*b* described below.

Light Incidence Angle Deriving Step (step 102*a*)

First, angles of incidence of the light from the light source placed at the light source position are derived for respective portions of the free-formed surface 20.

Figure 4:
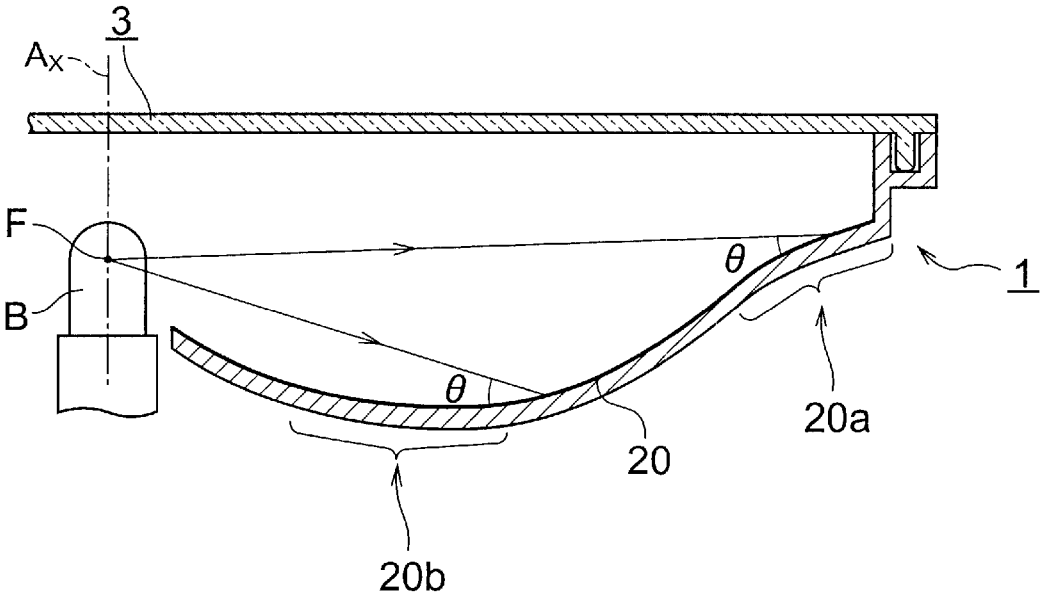
FIG. 4 is a cross-sectional view for explaining the evaluation of incidence angles of light on the free-formed surface.

FIG. 4 is a cross-sectional side view by a plane parallel to the optical axis Ax, of the lamp shape where the free-formed surface 20 is assumed to be the reflective surface shape of the reflector 1 (which is thus different from the shape of the lamp actually fabricated).

A light incidence angle θ used in the evaluation of the free-formed surface 20 is given as follows; as illustrated in FIG. 4, the light source (light source bulb B) is assumed to be placed at the light source position (illuminant point F) set in the condition setting step 100 and the light incidence angle θ is defined as an angle between an incident ray of the light from the light source to the free-formed surface 20, and the free-formed surface 20. This light incidence angle θ is determined for each of the portions on the free-formed surface 20. If there is any portion without incidence of the light from the light source as being shadowed by another portion of the free-formed surface 20, it will also be investigated.

Light Incidence Angle Distribution Evaluating Step (step 102*b*)

The next step is a step of preparing and evaluating a light incidence angle distribution based on the light incidence angles θ at the respective portions of the free-formed surface 20, gained in the light incidence angle deriving step 102*a*, and selecting a free-formed surface to be used in the creation of the reflective surface 10*a*.

If a portion has a too small light incidence angle θ among those θ on the free-formed surface 20 there will arise a problem of decrease in quantity of light incident to that portion. For example, where the shape of the entire reflective surface is rectangular, the portions near the four corners thereof on the free-formed surface 20 are distant from the light source (see FIG. 1 and FIG. 2). In this case, in the diagonal directions of the rectangular shape toward the four corners, the shape of the free-formed surface 20 becomes flatter in the far range than the other portions in order to make the light from the light source incident up to the portions at the four corners and it can make the light incidence angles θ from the light source smaller in certain cases (e.g., the area 20*a* illustrated in FIG. 4). There are also cases wherein a local convex area appears on the free-formed surface 20, depending upon the positional relation with the other members located near the lamp when the lamp is installed on the vehicle body.

In order to overcome these problems, a tolerated angle distribution condition is preliminarily set, and the light incidence angle distribution obtained for the free-formed surface 20 is evaluated according to this condition, to select a preferred free-formed surface 20.

Concerning the light incidence angle distribution, it is preferable to make the light incidence angle distribution and prepare two-dimensional image data indicating the light incidence angle distribution by data processing of the data of light incidence angles θ obtained for the respective portions of the free-formed surface 20 in the light incidence angle deriving step 102*a*, with a computer or the like. By displaying such two-dimensional image data on a display device (e.g., on a display of the computer), the designer is allowed to determine whether the light incidence angle distribution data displayed meets the angle distribution condition. In this case, construction methods of the two-dimensional image data include a method of setting colors of pixels corresponding to the respective portions of the free-formed surface 20, based on the light incidence angles, and indicating the angle distribution by a color distribution thereof, a method of indicating the angle distribution with contourlike equi-incidence-angle curves, and so on.

It may also be contemplated to digitize the angle distribution condition applied to the light incidence angle distribution, into digital data and make the computer or the like perform an operation to automatically determine whether the light incidence angle distribution gained satisfies the digitized angle distribution condition.

On the other hand, the angle distribution condition used in the evaluation of the light incidence angles θ and in the selection of the free-formed surface 20 can be properly selected for each of lamps according to the type of lamp, required function, and so on. A condition generally employed is the condition for keeping the light incidence angles θ of the light from the light source from becoming too small as described above. In this case, the step can be adapted to set a tolerated minimum of the light incidence angles θ as the angle distribution condition and select a free-formed surface 20 in which the light incidence angles θ are not less than the set minimum throughout the entire light incidence angle distribution.

Another potential condition is a condition for keeping change rates of the light incidence angles θ in the angle distribution (incidence angle change against position change in the surface of the free-formed surface 20) from becoming too large. In this case, the step can be adapted to set a tolerated maximum of the incidence angle change rates as the angle distribution condition and select a free-formed surface 20 in which the incidence angle change rates are not more than the set maximum throughout the entire light incidence angle distribution (or in which there is no region with a quick change of incidence angle).

Concerning these angle distribution conditions, the condition does not always have to be expressed by digitized form, but the condition may also be set, for example, in the form of determination criteria for permitting the designer to judge referring to the image data indicating the light incidence angle distribution.

Reflective Surface Creating Step (step 103)

Next, the reflective surface 10*a* including a plurality of reflective surface elements 40 is created using the free-formed surface 20 selected in the free-formed surface selecting step 102.

In this step, the reflective surface 10*a* is created by dividing the free-formed surface 20 into a plurality of segments and assigning reflective surface elements to the respective segments. For example, in the case of the reflector 1 illustrated in FIG. 2, the X-axis direction and the Y-axis direction perpendicular to each other are set as two divisional directions and the free-formed surface 20 is divided in the rectangular shape at a fixed pitch along each of the directions when viewed from the Z-axis direction, thereby creating a plurality of segments 41 arranged in an array pattern. Then a reflective surface element 40 of a predetermined face shape is assigned to each of these segments 41, thereby forming the whole of the reflective surface 10*a*. A variety of methods can be applied to the division of the free-formed surface 20 into the segments; for example, a method of directly dividing the area on the free-formed surface 20, a method of setting a separate virtual plane for design and performing the division, based on the virtual plane, and so on.

Figure 5:
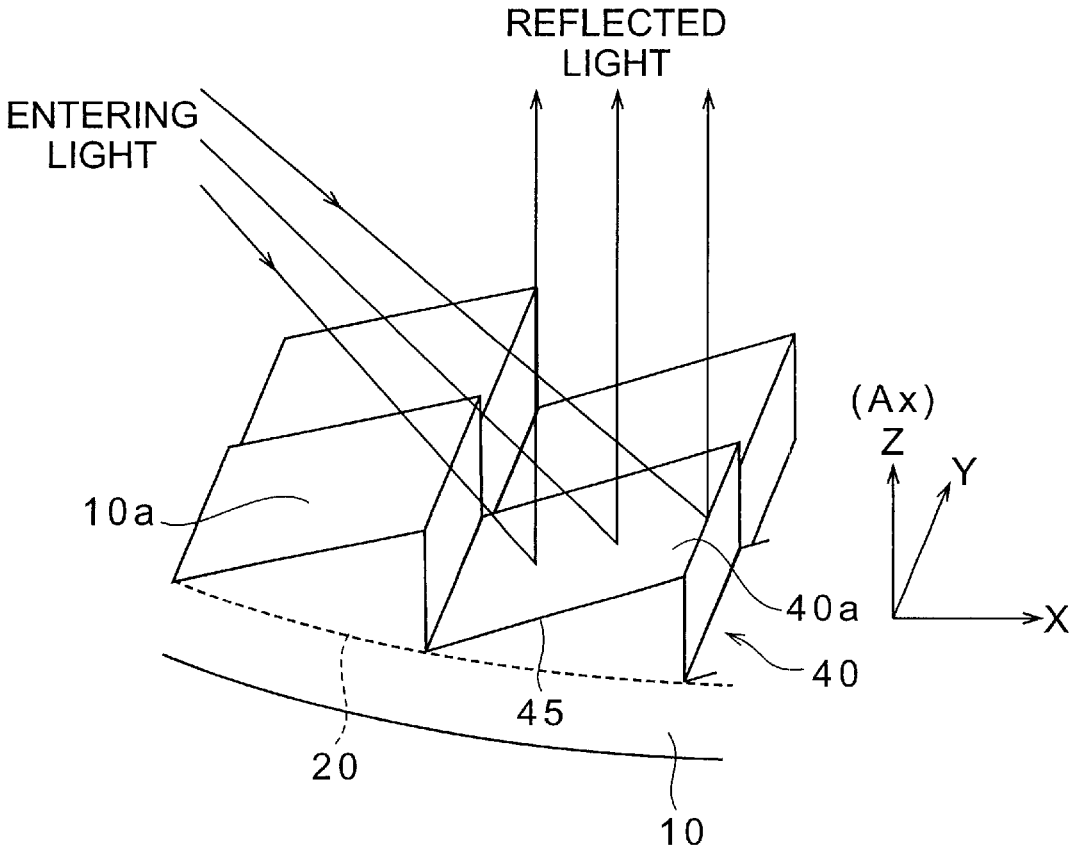
FIG. 5 is a perspective view to show an example of the reflective surface shape of the reflective surface elements.

It is preferable to select a surface shape that reflects the light from the light source placed at the illuminant point F into the direction of the optical axis Ax (the Z-axis), as a reflective surface shape of the reflective surface element 40 assigned to each segment 41, as illustrated in FIG. 5. At this time, a specific surface shape of the reflective surface 40*a* in each reflective surface element 40 is a paraboloid of revolution generated with the focus at the illuminant point F, the center axis along the optical axis Ax, and the focal length (varying depending upon the reflective surface elements 40) set corresponding to the position of each segment 41 on the free-formed surface 20. In the reflective surface element 40 illustrated in FIG. 5, the whole of the reflective surface 40*a* is composed of a paraboloidal surface 45 which is a paraboloid of revolution. It may also be contemplated to employ a plane approximate to a paraboloid of revolution, as each surface shape, depending upon the size of the segment 41, actual reflector fabrication accuracy, and so on.

Figure 6:
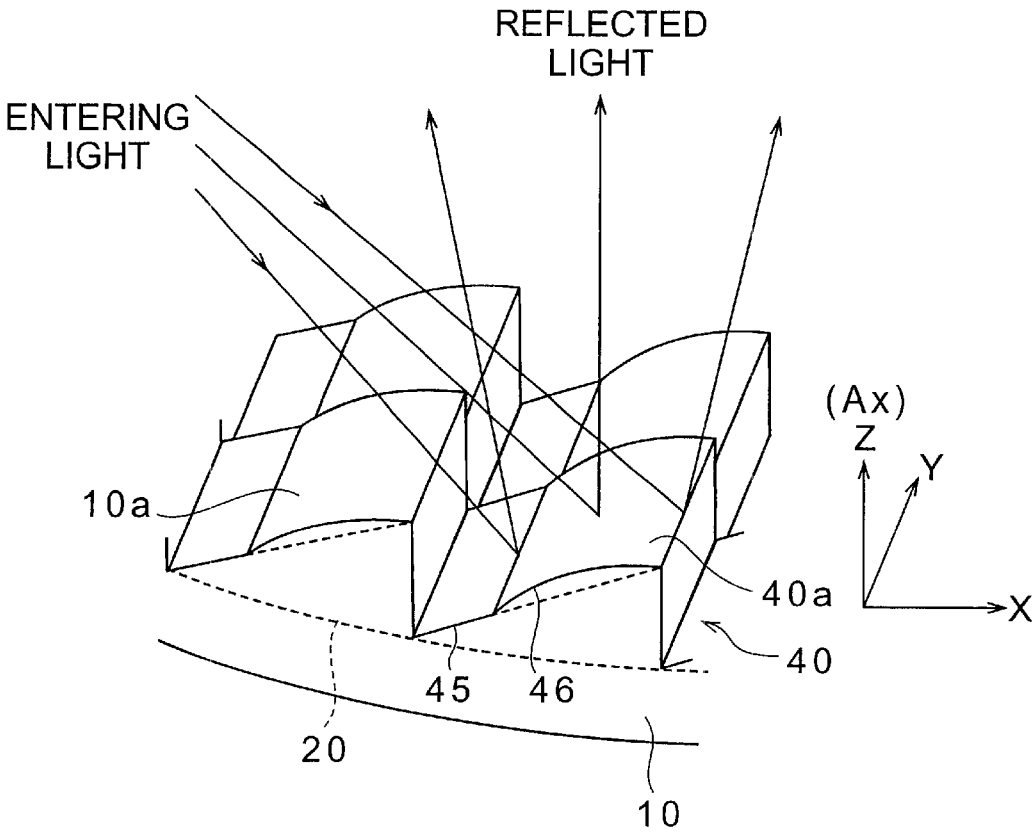
FIG. 6 is a perspective view to show another example of the reflective surface shape of the reflective surface elements.

The reflective surface shape of each reflective surface element 40 can also be a surface shape that diffusely reflects the light from the light source placed at the illuminant point F into diffuse directions within a predetermined angular range including the optical axis Ax (the Z-axis), as illustrated in FIG. 6. In this case, a specific surface shape of the reflective surface 40*a* in each reflective surface element 40 can be such a modified form from the above shape of the paraboloid of revolution as to have predetermined light diffusing capability. In the reflective surface element 40 illustrated in FIG. 6, the reflective surface 40*a* thereof is composed of a paraboloidal surface 45 formed in the shape of the paraboloid of revolution and a diffuse reflection surface 46 so formed (or deformed) in the convex shape relative to the shape of the paraboloid of revolution as to have the light diffusing capability.

Here the paraboloidal surface 45 is the part shadowed by an adjacent reflective surface element 40 and the part actually receiving the light from the light source bulb B is made as the diffuse reflection surface 46 in the example of FIG. 6. This diffuse reflection surface 46 is formed in a cylindrical shape so as to have the light diffusing capability only in the X-axis direction and the light is reflected in a state of nearly parallel light in the Y-axis direction. At this time, the lens 3 of the vehicle lamp is constructed, for example, of lens steps 3*a* with the light diffusing capability in the Y-axis direction, as illustrated in FIG. 1.

The light diffusing capability of the reflective surfaces 40*a* of the reflective surface elements 40 is set depending upon the appearance constraints and the functional conditions required of the lamp, the shape of the lens 3 used, and so on. For example, the diffuse reflection surface 46 can also be shaped with the light diffusing capability in two directions of the X-axis direction and the Y-axis direction.

Reflective Surface Selecting Step (step 104)

The next step is a step of selecting a reflective surface to be used in the reflector 1, out of reflective surfaces 10*a* created in the reflective surface creating step 103.

In the present embodiment, the reflective surface selecting step 104 consists of the evaluation surface defining step 104*a*, evaluation point setting step 104*b*, light reflecting region deriving step 104*c*, and light reflecting region distribution evaluating step 104*d* described below.

Evaluation Surface Defining Step (step 104*a*)

In the first step, an evaluation axis Lx and a corresponding evaluation surface 50 used for the evaluation are defined for the reflective surface 10*a* created in the reflective surface creating step 103.

Figure 7:
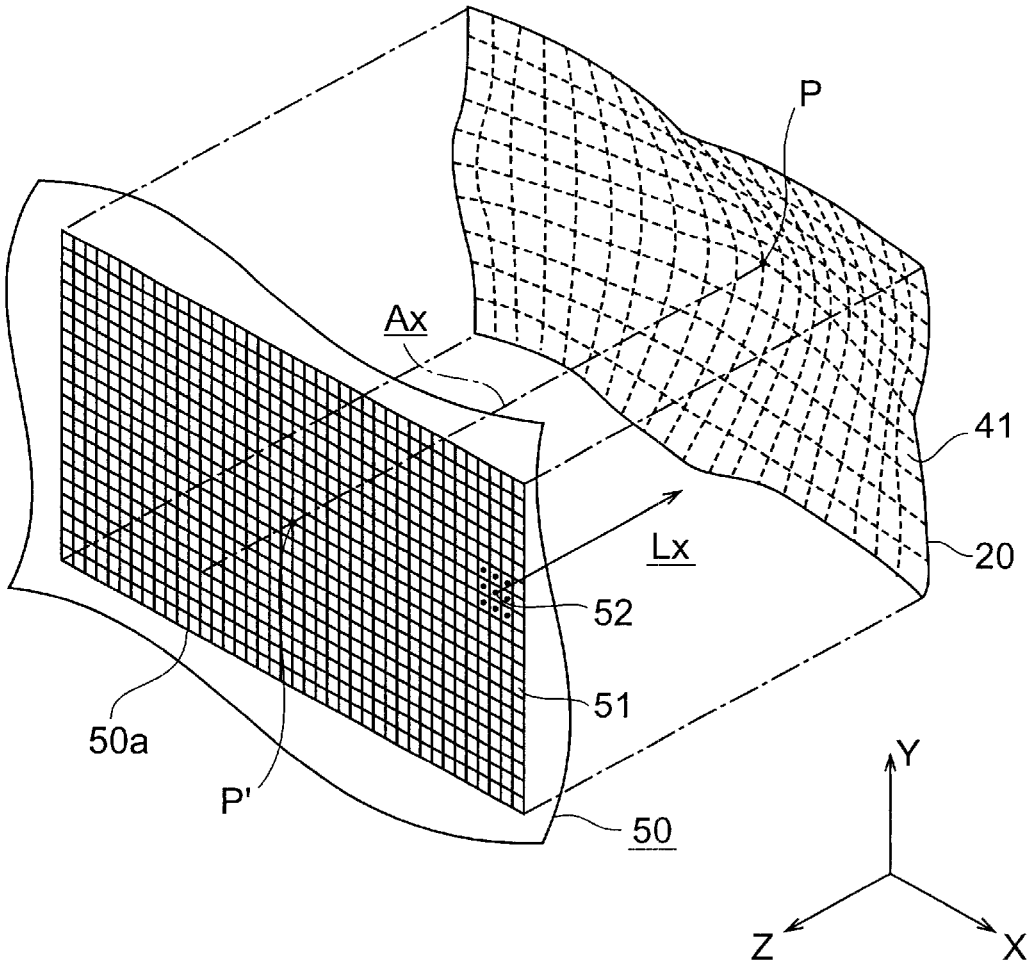
FIG. 7 is a perspective view to show setting of an evaluation axis, an evaluation surface, and evaluation points.

FIG. 7 is a perspective view to show the setting of the evaluation axis Lx and the evaluation surface 50 for the reflective surface 10*a*. FIG. 7 shows the free-formed surface 20 divided in the plurality of segments 41, instead of the reflective surface 10*a* consisting of the plurality of reflective surface elements 40, in order to illustrate the correspondence between the segments 41, to which the reflective surface elements 40 are assigned, and evaluation segments 51 on the evaluation surface 50.

The first step is the step of setting the evaluation axis Lx for the evaluation of the reflective surface 10*a* (which is indicated by the free-formed surface 20 in FIG. 7). The evaluation axis Lx is used for evaluating reflecting regions during the on periods of the lamp (or for evaluating how the lamp lights up), by checking presence/absence of light reflecting from the reflective surface 10*a* into the direction of this evaluation axis Lx, and is set along the optical axis Ax, or along an axis making a predetermined angle relative to the optical axis Ax. In the example illustrated in FIG. 7, the evaluation axis Lx is set in agreement with the optical axis Ax.

A virtual plane for evaluation opposed to the reflective surface 10*a* is defined as the evaluation surface 50 in correspondence to the evaluation axis Lx. The evaluation surface 50 is equivalent to the field plane when the reflective surface 10*a*, or the lamp including the reflector 1 is observed from the direction of the evaluation axis Lx. For example, the evaluation surface 50 is set as a plane perpendicular to the evaluation axis Lx, including a point P' corresponding to the point P on the free-formed surface 20 where the optical axis Ax passes. Here a sectional area indicating a region (the rectangular region in FIG. 7) corresponding to the reflective surface 10*a* on the evaluation surface 50 is defined as a outline 50*a* of reflective surface.

Evaluation Point Setting Step (step 104*b*)

Next, a plurality of evaluation points 52 used for the evaluation are set on the evaluation surface 50 defined in the evaluation surface defining step 104*a*.

The evaluation points 52 are points of bases in ray tracing for the evaluation of optical reflection and are set in a distribution under predetermined conditions including the number, arrangement, etc. necessary for the evaluation of optical reflection and the selection of the reflective surface 10*a*, in the reflective surface outline 50*a* on the evaluation surface 50. FIG. 7 shows a method of setting the evaluation points 52, based on a plurality of evaluation segments 51 generated on the evaluation surface 50, as an example of the method of setting such evaluation points 52.

In the example illustrated in FIG. 7, the area inside the reflective surface outline 50*a* on the evaluation surface 50 is first divided at a fixed pitch along the two divisional directions of the X-axis direction and the Y-axis direction to generate a plurality of evaluation segments 51. These evaluation segments 51 are basically set independently of the segments 41 in the reflective surface 10*a*.

At this time, it is preferable to make the dividing pitch for the creation of the evaluation segments 51 smaller than the dividing pitch of the segments 41 in order to evaluate the distribution of optical reflection in each reflective surface element 40 (segment 41) of the reflective surface 10*a*. In FIG. 7, the pitch of the evaluation segments 51 is drawn in half (or a fraction of an integer) of the pitch of the segments 41. This pitch of the evaluation segments 51, however, does not always have to be set to a fraction of an integer of the pitch of the segments 41.

In the subsequent step, at least one evaluation point 52 is set in each of the evaluation segments 51. FIG. 7 shows the evaluation points 52 set in an evaluation segment 51 located third from the right edge and eighth from the upper edge out of the evaluation segments 51 in the reflective surface outline 50*a*, and in evaluation segments 51 surrounding it. The other evaluation points are omitted from the illustration, but each of these evaluation points 52 is set at one point of the center similarly for all the evaluation segments 51 inside the reflective surface outline 50*a*. In the figure the evaluation axis Lx is indicated by an arrow directed toward the reflective surface 10*a* (free-formed surface 20) from the evaluation point 52 in the above evaluation segment 51.

Light Reflecting Region Deriving Step (step 104*c*)

Next, ray tracing is carried out from the plurality of evaluation points 52 set in the evaluation point setting step

104*b* to obtain reflecting regions of light, by checking presence/absence of optical reflection in each portion of the reflective surface 101*a*.

Figure 8:
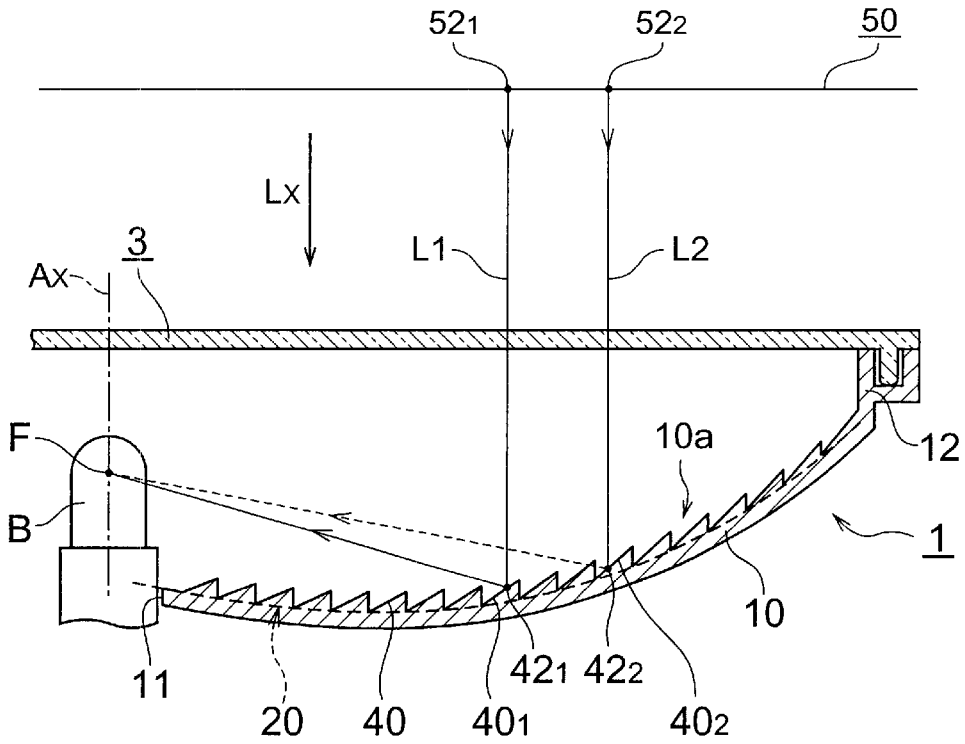
FIG. 8 is a cross-sectional view for explaining the evaluation of the light reflecting regions in the reflective surface.

FIG. 8 is a cross-sectional side view by a plane parallel to the optical axis Ax of the lamp shape where the reflective surface 10*a* consisting of the plurality of reflective surface elements 40 is applied to the reflective surface shape of the reflector 1. In this FIG. 8, the ray tracing from two evaluation points $\mathbf{52}_1$ and $\mathbf{52}_2$ on the evaluation surface 50 is illustrated as an example of the ray tracing for the evaluation of optical reflection.

The ray tracing from the evaluation points 52 is carried out as follows. A ray is drawn from each evaluation point 52 on the evaluation surface 50 along the direction of the evaluation axis Lx toward the reflective surface 10*a* and the ray undergoes reflection at a reflective point 42 which is an intersecting point of the ray with the reflective surface 10*a* (i.e., the reflective surface 40*a* of each reflective surface element 40). Then presence/absence of optical reflection (emergence of light from the lamp) in the direction of the evaluation axis Lx at each portion on the reflective surface 10*a* is determined based on whether the reflected ray arrives at the light source position (the illuminant point F).

In the example illustrated in FIG. 8, the ray L1 from the evaluation point $\mathbf{52}_1$ is reflected at the reflective point $\mathbf{42}_1$ on the reflective surface of the reflective surface element $\mathbf{40}_1$ to reach the illuminant point F on the optical axis Ax. Therefore, it is determined that at this evaluation point $\mathbf{52}_1$ there is optical reflection by the reflective surface 10*a*, i.e., emergence of light during the on periods.

On the other hand, the ray L2 from the evaluation point $\mathbf{52}_2$ is reflected at the reflective point $\mathbf{42}_2$ on the reflective surface of the reflective surface element $\mathbf{40}_2$, but the reflected ray does not arrive at the illuminant point F, because there exists another reflective surface element adjacent on the light source side in the reflected light path. Therefore, it is determined that at this evaluation point $\mathbf{52}_2$ there is no optical reflection by the reflective surface 10*a*.

This evaluation of optical reflection by the ray tracing is carried out in order for all the evaluation points 52 set on the evaluation surface 50, thereby obtaining reflecting regions in which the light from the light source placed at the light source position is reflected into the direction of the evaluation axis Lx during the on periods of the lamp.

The light reflecting regions may also be determined with additional consideration to the effect resulting from the fact that the light source placed at the light source position has the finite size and shape (for example, a filament shape) different from the point light source, if necessary. In this case, the evaluation can be made, for example, by a method of determining the presence of optical reflection when the light arrives within the set range of the light source position.

Light Reflecting Region Distribution Evaluating Step (step 104*d*)

The next step is a step of preparing and evaluating the light reflecting region distribution, based on the light reflecting regions in the respective portions of the reflective surface 10*a* (presence/absence of optical reflection in the respective portions) obtained in the light reflecting region deriving step 104*c*, to select a reflective surface to be used in the fabrication of the reflector 1.

There will arise the problem of heavy nonuniformity of the light emitted from the lamp during the on periods thereof if the light reflecting regions on the reflective surface 10*a* include those with a large rate of the portion without optical reflection (hereinafter referred to as a dark portion) behind another reflective surface element to the portion with optical reflection (hereinafter referred to as a bright portion) in each reflective surface element 40 or those having distribution deviation of bright and dark portions, e.g., regions with many dark portions, regions with many bright portions, or the like across the entire reflective surface 10*a*. For example, in the case wherein the reflective surface elements 40 are assigned to a region of a concave shape or a shape close thereto on the free-formed surface 20 when viewed from the light source, like the area 20*b* illustrated in FIG. 4, or to a region with large change in the surface shape on the free-formed surface 20, such brightness difference becomes enhanced, so as to make optical nonuniformity prominent in certain cases.

A tolerated region distribution condition is preliminarily set to overcome this problem and the light reflecting region distribution obtained for the reflective surface 10*a* is evaluated according to this condition, to select a preferred reflective surface 10*a*.

It is preferable as to the light reflecting region distribution to prepare the light reflecting region distribution by data processing with a computer or the like, of the data of the light reflecting regions (the data of presence/absence of optical reflection) obtained for the respective portions of the reflective surface 10*a* in the light reflecting region deriving step 104*c*, and prepare two-dimensional image data indicating the light reflecting region distribution. When this two-dimensional image data is displayed, the designer is allowed to determine whether the light reflecting region distribution displayed satisfies the region distribution condition, similarly as in the selection of the free-formed surface 20. In this case, an example of construction of the two-dimensional image data is a method of setting white (bright) or black (dark) to pixels corresponding to each portion of the reflective surface 10*a*, based on presence/absence of optical reflection (bright/dark during the on periods), and evaluating the region distribution by a black and white pattern of pixels.

Another possible method is a method of digitizing the region distribution condition applied to the light reflecting region distribution into digital data and making the computer or the like perform an operation to automatically determine whether the light reflecting region distribution obtained satisfies the digitized region distribution condition.

In the case of the example wherein the evaluation of optical reflection is carried out by dividing the area inside the reflective surface outline 50*a* on the evaluation surface 50 into the evaluation segments 51 and setting the evaluation points 52 in the respective segments as illustrated in FIG. 7, the light reflecting region distribution can be made by using the presence/absence of optical reflection obtained for the evaluation points 52, as presence/absence of optical reflection in the corresponding evaluation segments 51.

Figure 9:
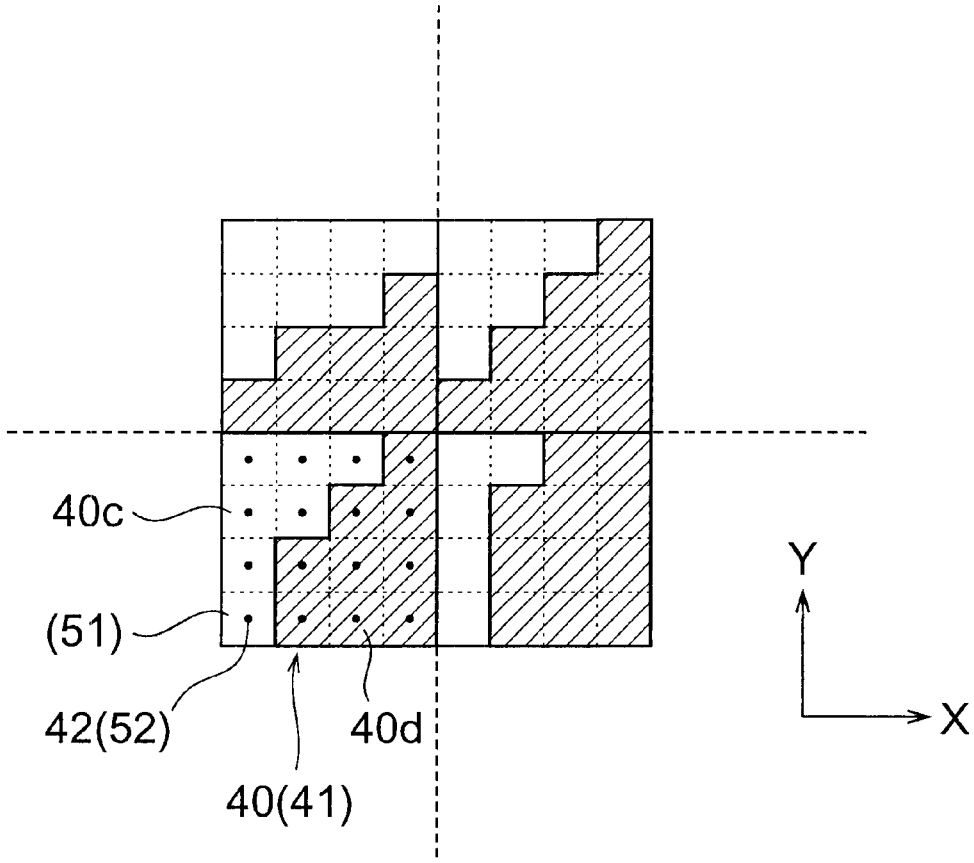
FIG. 9 is a plan view to show an enlarged view of a part of a light reflecting region distribution in the reflective surface.

FIG. 9 is a plan view to show an enlarged view of a part of the reflective surface 10*a* as to the light reflecting region distribution obtained in this way. FIG. 9 shows four segments 41 of 2×2 and the reflective surface elements 40 assigned thereto (the four squares indicated by the solid lines) for the array of segments 41 each in the approximately square segment shape. On the other hand, the evaluation segments 51 are arranged at the pitch equal to quarter of the pitch of the segments 41 both in the X-axis direction and in the Y-axis direction and FIG. 9 shows sixty four evaluation segments 51 of 8×8 corresponding to the above reflective surface elements 40 (sixty four squares indicated by dashed lines).

Evaluation points 52, which are set as center points of the respective evaluation segments 51, are illustrated for the sixteen evaluation segments 51 located inside the reflective surface element 40 located lower left in the figure among the four reflective surface elements 40. The other evaluation points 52 not illustrated are also set similarly. These evaluation points 52 agree with the reflective points 42 on the reflective surface 10*a* on the plan view when the evaluation axis Lx agrees with the optical axis Ax.

The bright-dark pattern of bright portions 40*c* (white regions) and dark portions 40*d* (hatched regions) in the light reflecting region distribution illustrated in FIG. 9 is one made by evaluating "bright" (with optical reflection) or "dark" (without optical reflection) in each evaluation segment 51, based on presence/absence of optical reflection at the evaluation point 52 being the center point of that evaluation segment 51. The bright-dark pattern illustrated is an example of a pattern appearing in the reflective surface elements 40 located nearly upper left of the light source (see FIG. 2), and the overall light reflecting region distribution is obtained by making such bright-dark patterns over the whole of the reflective surface 10*a*.

The region distribution condition used for the evaluation of the light reflecting regions and the selection of the reflective surface 10*a* can be properly set for each lamp according to the type of the lamp, the required function, etc., similar to the angle distribution condition for the free-formed surface 20. It is common practice to select a condition for avoiding occurrence of a portion in which the rate of dark portions in a certain regional range is larger than those of the other regions. In this case, for example, the condition can be selected as follows. The area inside the reflective surface 10*a* is divided into regions slightly larger than the evaluation segments 51 and segments 41, average brightness is determined for each of the regions, the region distribution condition is set as a maximum and a minimum of such brightness, or as an upper limit of a ratio thereof, nonuniformity of bright-dark distribution is evaluated according to the region distribution condition thus set, and a reflective surface 10*a* with the bright-dark distribution within the tolerance is selected.

Another possible condition is a condition for preventing change of brightness and darkness (brightness change against positional change in the surface of the reflective surface 10*a*) in the region distribution from becoming too large. In this case, a tolerated maximum of brightness change rates is set as the region distribution condition in the evaluation of bright-dark distribution as described above, and the reflective surface 10*a* can be selected as one in which the brightness change rates are not more than the set maximum throughout the entire light reflecting region distribution (or in which there is no portion of quickly changing brightness).

It is noted that these region distribution conditions do not always have to be expressed by digital form, but the conditions may also be presented as determination criteria for permitting the designer to judge referring to the image data indicating the light reflecting region distribution.

Reflective Surface Determining Step (step 105)

The shape of the reflective surface 10*a* to be used for the reflector 1 is determined based on the reflective surface 10*a* obtained through the above steps.

In this step, the reflective surface 10*a* selected in the reflective surface selecting step 104 is basically employed as the surface shape as it is, but correction or adjustment or the like for the shape may also be effected depending upon constraints from the actual fabrication of the reflector. Portions subject to the adjustment are, for example, taper shapes of step portions at the border between adjacent reflective surface elements 40, roundness of corner portions, and so on.

After the final surface shape of the reflective surface 10*a* is determined, the total shape of the reflector 1 is determined based thereon and the reflector is fabricated based on the shape data.

If the free-formed surface 20 or the reflective surface 10*a* does not satisfy the given condition in the free-formed surface selecting step 102 or in the reflective surface selecting step 104, the processing flow will return to the free-formed surface creating step 101 or to the reflective surface creating step 103 to again create another free-formed surface or another reflective surface, and the evaluation and selection will be repeated for them.

In the reflective surface determining method of the reflector in the vehicle lamp according to the present embodiment, as described above, the evaluation and selection of the surface shape is carried out by the different methods at the two stages, which are the stage of creation of the free-formed surface 20 being the basic shape and the stage of creation of the reflective surface 10*a* after the assignment of the reflective surface elements 40 in the designing process of the reflective surface shape. This permits the reflective surface to be obtained with reduced optical nonuniformity during the on periods of the lamp while meeting both the shape constraints and the functional conditions. It also becomes feasible to improve the design efficiency of the surface shape for obtaining such a reflective surface and to determine the reflective surface shape within shorter time.

In the embodiment described above, the evaluation of the light reflecting regions at the stage of the reflective surface is the evaluation based on ray tracing by defining the evaluation surface corresponding to the evaluation axis and setting a plurality of evaluation points on this evaluation surface. This method permits suitable determination of the locations of the evaluation points etc. and further facilitates the preparation of the light reflecting region distribution data in a view from the direction of the evaluation axis. Particularly, the evaluation steps can be carried out more efficiently by making use of the evaluation segments obtained by dividing the area on the evaluation surface.

By carrying out the ray tracing from the evaluation point side toward the reflective surface in this case, the evaluation of the light reflecting regions can be performed by ray tracing computation of minimum necessity, thereby simplifying the steps of evaluation and selection.

The reflective surface determining method of the reflector in the vehicle lamp according to the present invention does not have to be limited to the embodiment described above, but various modifications and changes of structure can be made depending upon specific constraints etc. imposed on the individual lamps.

For example, the example of the light reflecting region distribution illustrated in FIG. 9 uses the black and white pattern of the bright portion 40*c* and the dark portion 40*d*, but the evaluation and selection may also be conducted as to the difference of light quantity (brightness) in each portion inside the bright portion 40*c*. In this case, the image data indicating the light reflecting region distribution can be prepared by use of a multi-step gray scale or by color coding.

The evaluation of optical reflection in the reflective surface selecting step 104 does not have to be limited to only once, but may also be carried out plural times using a plurality of different evaluation axes Lx.

For example, in the case wherein the reflective surfaces 40*a* of the reflective surface elements 40 are comprised of the paraboloidal surfaces 45 which reflect the light from the light source into the direction of the optical axis Ax as in the example illustrated in FIG. 5, single optical reflection evaluation suffices with the evaluation axis Lx along the optical axis Ax, because all the light from the light source is reflected into the direction of the optical axis Ax.

On the other hand, in the case wherein the reflective surfaces 40*a* of the reflective surface elements 40 include the diffuse reflection surfaces 46 for diffusely reflecting the light from the light source relative to the optical axis Ax as in the example illustrated in FIG. 6, the selection of the reflective surface 10*a* may also be conducted by setting a plurality of evaluation axes Lx, carrying out the optical reflection evaluation with each of the axes, and totally considering the results of the evaluation.

In the case wherein the diffuse reflection surfaces are provided in the final reflective surface 10*a*, the reflective surface 10*a* may also be selected by constructing the surface shapes of the reflective surface elements 40 of only the shapes of paraboloids of revolution in the reflective surface creating step 103 and carrying out the optical reflection evaluation using the optical axis Ax as the evaluation axis Lx in the reflective surface selecting step 104. In this case, the final reflective surface shape can be determined by further carrying out the modification of providing the selected reflective surface 10*a* with the diffuse reflection surfaces.

Figure 10:
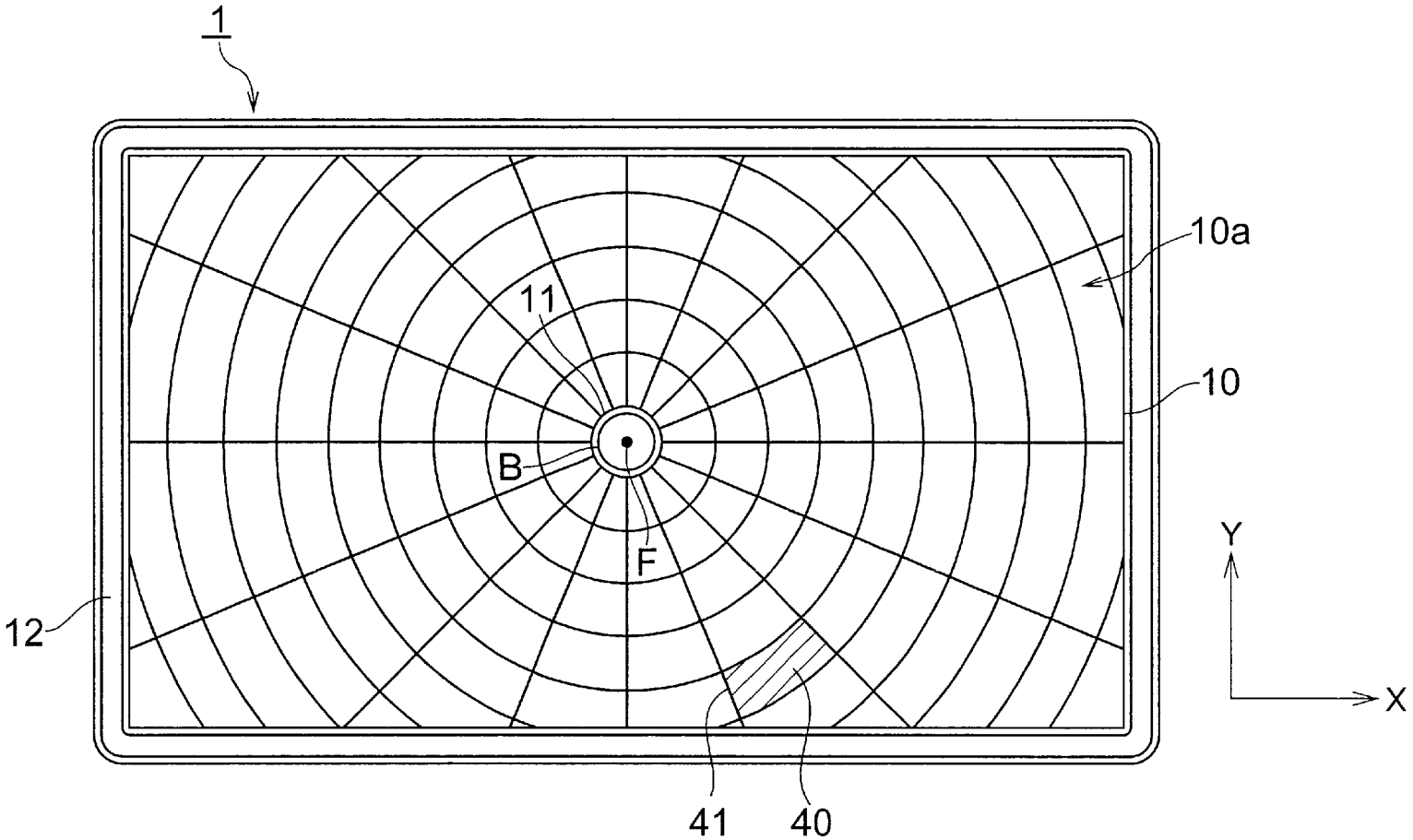
FIG. 10 is a plan view to show another example of the structure of the reflector in the vehicle lamp.

The segment shape of the reflective surface 10*a* is not limited to the rectangular shape described in the above embodiment, either. FIG. 10 is a plan view to show another configuration of the reflector in the vehicle lamp. In this example, a plurality of segments 41 to which the respective reflective surface elements 40 are assigned are created by dividing the reflective surface 10*a* along radial directions of radius vectors from the center of the optical axis Ax and along circumferential directions of concentric circles with the center on the optical axis Ax. In this example, each of the segments 41 is of the sector shape as illustrated in FIG. 10.

For evaluating the optical reflection of the reflective surface 10*a* of this segment shape, the evaluation segments 51 on the evaluation surface 50 may be of the array shape along the divisional directions of the X-axis direction and the Y-axis direction as in the above embodiment (see FIG. 7), or may also be the evaluation segments 51 of the sector shape corresponding to the structure of the reflective surface 10*a*.

The above reflective surface determining method can also be applied similarly to a variety of segment shapes other than the above. As for the types of the lamps, the above method can also be applied to reflectors used not only for the marker lamps, but also for various types of vehicle lamps.

The reflective surface determining method of the reflector in the vehicle lamp according to the present invention, as detailed above, can be utilized as a reflective surface determining method of a reflector with reduced nonuniformity of in-surface optical distribution during the on periods of the lamp. Namely, the evaluation of surface shape in the determination (or in the designing) of the reflective surface shape is not carried out after the determination of the reflective surface shape, but the surface shape is selected by carrying out the two evaluation steps by the different methods at the two stages, i.e., the evaluation according to the functional conditions such as the light incidence angles or the like at the stage of the free-formed surface being the basic shape and the evaluation according to the light reflecting regions at the stage of the reflective surface with the plurality of reflective surface elements assigned. This reduces the nonuniformity of the in-surface light distribution during the on periods of the lamp in the vehicle lamp provided with the reflector made using the resultant reflective surface shape. It also simplifies the design steps for obtaining the reflective surface shape, thereby improving the design efficiency.

Particularly, when the conditions from the body side impose severe shape constraints, e.g., the decrease in the depth of the lamp or the like, the method of the present invention is effectively applicable and can provide the reflector complying with the various constraints and fully meeting the functionally preferred conditions as a lamp.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A method of determining a reflective surface of a reflector used in a vehicle lamp, said method comprising:

a condition setting step of setting a light source position at which a light source is to be placed, and an optical axis that passes said light source position and that defines a direction into which light from said light source is to be reflected by a reflector;

a free-formed surface creating step of creating a free-formed surface satisfying a predetermined shape constraint;

a free-formed surface selecting step of selecting said free-formed surface satisfying a predetermined functional condition, as a free-formed surface to be used for creation of a reflective surface;

a reflective surface creating step of dividing said free-formed surface selected, into a plurality of segments and assigning a reflective surface element for reflecting the light from said light source placed at said light source position, into the direction along said optical axis, to each of said segments, thereby creating a reflective surface including a plurality of said reflective surface elements; and a reflective surface selecting step of setting an evaluation axis for evaluation of optical reflection characteristics of said reflective surface, preparing a light reflecting region distribution by determining for each portion of said reflective surface a reflecting region accepting the light from said light source placed at said light source position and reflecting the light into the direction of said evaluation axis, and selecting said reflective surface with said light reflecting region distribution satisfying a predetermined region distribution condition, as a reflective surface to be used for the reflector.

2. The method according to claim 1, wherein said free-formed surface selecting step comprises a step of preparing a light incidence angle distribution by determining for each portion of said free-formed surface an incidence angle of the light from said light source placed at said light source position, and selecting said free-formed surface with said light incidence angle distribution satisfying an angle distribution condition being said predetermined functional condition, as a free-formed surface to be used for creation of the reflective surface.

3. The method according to claim 1, wherein said reflective surface selecting step comprises:

an evaluation surface defining step of defining a plane opposed to said reflective surface, as an evaluation surface;

an evaluation point setting step of setting a plurality of evaluation points on said evaluation surface;

a light reflecting region deriving step of virtually drawing a ray along the direction of said evaluation axis from each of said evaluation points on said evaluation surface toward said reflective surface, reflecting the incident ray at a reflective point on said reflective surface toward said light source position, determining presence/absence of arrival of the reflected ray at said light source position, and determining said reflecting region by using the presence/absence of arrival of the reflected ray at said light source position, as presence/absence of optical reflection into the direction of said evaluation axis at each portion of said reflective surface; and a light reflecting region distribution evaluating step of preparing said light reflecting region distribution using said reflecting regions obtained and carrying out evaluation of said reflective surface, based thereon.

4. The method according to claim 3, wherein said evaluation point setting step comprises a step of dividing a region on said evaluation surface into a plurality of evaluation segments and setting at least one said evaluation point in each of said evaluation segments, and wherein in said light reflecting region deriving step, presence/absence of optical reflection determined for each of said evaluation points set in the respective evaluation segments, is used as presence/absence of optical reflection in said evaluation segments.

5. The method according to claim 4, wherein said evaluation point setting step comprises a step of creating said evaluation segments by dividing the evaluation surface at a pitch smaller than that of said segments with said reflective surface elements assigned thereto.

6. The method according to claim 1, wherein said reflective surface creating step comprises a step of setting a surface shape of each of said plurality of reflective surface elements to a shape for reflecting the light from said light source placed at said light source position, into the direction of said optical axis, and wherein said reflective surface selecting step comprises a step of selecting said reflective surface according to said light reflecting region distribution obtained with said evaluation axis set along said optical axis.

7. The method according to claim 1, wherein said reflective surface creating step comprises a step of setting a surface shape of each of said plurality of reflective surface elements to a shape having a diffuse reflection area for diffusely reflecting the light from said light source placed at said light source position, into diffuse directions within a predetermined range relative to said optical axis direction, and wherein said reflective surface selecting step comprises a step of setting a plurality of evaluation axes, obtaining said light reflecting region distribution with each of the evaluation axes, and selecting said reflective surface according to said light reflecting region distributions obtained.

* * * * *